US009957965B2

(12) United States Patent
Yamagata et al.

(10) Patent No.: US 9,957,965 B2
(45) Date of Patent: May 1, 2018

(54) AXIAL FLOW FAN

(71) Applicant: Nidec Corporation, Kyoto (JP)

(72) Inventors: Ryota Yamagata, Kyoto (JP); Tsukasa Takaoka, Kyoto (JP); Ryota Hayashida, Kyoto (JP); Atsushi Higashidani, Kyoto (JP); Shoki Yamazaki, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 281 days.

(21) Appl. No.: 14/872,541

(22) Filed: Oct. 1, 2015

(65) Prior Publication Data

US 2016/0097396 A1 Apr. 7, 2016

Related U.S. Application Data

(60) Provisional application No. 62/060,710, filed on Oct. 7, 2014.

(51) Int. Cl.

| | |
|---|---|
| ***F04D 29/54*** | (2006.01) |
| ***F04D 19/00*** | (2006.01) |
| ***F04D 25/06*** | (2006.01) |
| ***F04D 29/70*** | (2006.01) |

(52) U.S. Cl.

CPC ..... *F04D 19/002* (2013.01); *F04D 25/068* (2013.01); *F04D 25/0613* (2013.01); *F04D 29/703* (2013.01)

(58) Field of Classification Search

CPC ..... F04D 29/54; F04D 29/703

See application file for complete search history.

(56) References Cited

U.S. PATENT DOCUMENTS

| | | | | |
|---|---|---|---|---|
| 5,681,364 | A * | 10/1997 | Fortune | F04D 29/703 416/146 R |
| 2002/0015648 | A1 | 2/2002 | Kosugi | |
| 2003/0019646 | A1 | 1/2003 | Clements et al. | |
| 2006/0262499 | A1 | 11/2006 | Vinson et al. | |
| 2008/0124234 | A1 | 5/2008 | Echazarreta | |
| 2008/0279694 | A1 | 11/2008 | Chou et al. | |

(Continued)

FOREIGN PATENT DOCUMENTS

| | | | |
|---|---|---|---|
| CN | 101307769 | A | 11/2008 |
| CN | 203589927 | U | 5/2014 |

(Continued)

*Primary Examiner* — Patrick Hamo

(74) *Attorney, Agent, or Firm* — Keating & Bennett, LLP

(57) ABSTRACT

A fan includes a motor part, an impeller fixed to the motor part, a housing, and a first circuit board mounted with electronic components. The motor part includes an armature having coils, and a second circuit board connected to the coils and the first circuit board. The housing surrounds outer peripheries of the motor part and the impeller. The housing includes an intake port which is an upper opening of the housing, an exhaust port which is a lower opening of the housing, a flange portion enlarged radially outward from an outer circumferential surface of the housing, and a circuit board fixing portion protruding from the outer circumferential surface and making contact with the first circuit board. The first circuit board is disposed spaced apart from the outer circumferential surface, positioned radially inward of a radial outer edge of the flange portion, and arranged to extend in an axial direction.

12 Claims, 13 Drawing Sheets

(56) References Cited

U.S. PATENT DOCUMENTS

| | | | |
|---|---|---|---|
| 2010/0119385 | A1 | 5/2010 | Hanaoka et al. |
| 2012/0163973 | A1 | 6/2012 | Yu |
| 2014/0127049 | A1 | 5/2014 | Yoneda et al. |

FOREIGN PATENT DOCUMENTS

| | | | |
|---|---|---|---|
| JP | 6-000631 | Y2 | 1/1994 |
| JP | 2015/049075 | A1 | 4/2015 |
| WO | 03/058796 | A1 | 7/2003 |

* cited by examiner

AXIAL FLOW FAN

BACKGROUND OF THE INVENTION

1. Field of the Invention

The present invention relates to an axial flow fan.

2. Description of the Related Art

In recent years, due to the innovation of a motor technology, the use of an axial flow fan is diversified. In order to cope with different applications, a control circuit becomes complex and large-sized. For example, Japanese Utility Model Publication No. 6-631 discloses a structure in which modification such as addition of a special function pursuant to the use of a fan is performed without involving a substantial change in the external shape of the fan.

However, in the structure disclosed in Japanese Utility Model Publication No. 6-631, electronic components can be disposed only at the side of a split case. Thus, a countermeasure against the complexity and large-size of a circuit board is insufficient.

SUMMARY OF THE INVENTION

In one exemplary preferred embodiment of the present invention, a fan includes a motor part arranged to rotate about a center axis extending up and down, an impeller, a housing, a first circuit board and a plurality of ribs. The impeller includes a plurality of blades extending radially outward. The impeller is fixed to the motor part. The housing is arranged to surround outer peripheries of the motor part and the impeller. The housing includes a cylindrical inner circumferential surface and a cylindrical outer circumferential surface. The first circuit board is positioned radially outward of the outer circumferential surface of the housing and is electrically connected to the motor part. The ribs are arranged to interconnect the motor part and the housing. The motor part includes an armature having coils, and a second circuit board. The second circuit board is electrically connected to the coils and the first circuit board. The housing includes an intake port which is an upper opening of the housing, an upper edge which surrounds the intake port, an exhaust port which is a lower opening of the housing, a lower edge which surrounds the exhaust port, a flange portion enlarged radially outward from the outer circumferential surface of the housing, and a circuit board fixing portion protruding from the outer circumferential surface of the housing and making contact with the first circuit board. The first circuit board is mounted with a plurality of electronic components and is disposed in a spaced apart relationship with the outer circumferential surface of the housing. The first circuit board is positioned radially inward of a radial outer edge of the flange portion and is arranged to extend in an axial direction.

According to one exemplary preferred embodiment of the present invention, it is possible to dispose a large electronic component or a large-sized circuit board so as not to protrude from the flange portion of the fan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Some exemplary preferred embodiments of the present invention will now be described with reference to the accompanying drawings. In the following descriptions, the direction parallel to or substantially parallel to the center axis of the fan will be referred to as an "axial direction". The direction orthogonal to or substantially orthogonal to the center axis of the fan will be referred to as a "radial direction". The direction extending along an arc centered at the center axis of the fan will be referred to as a "circumferential direction".

Figure 1:
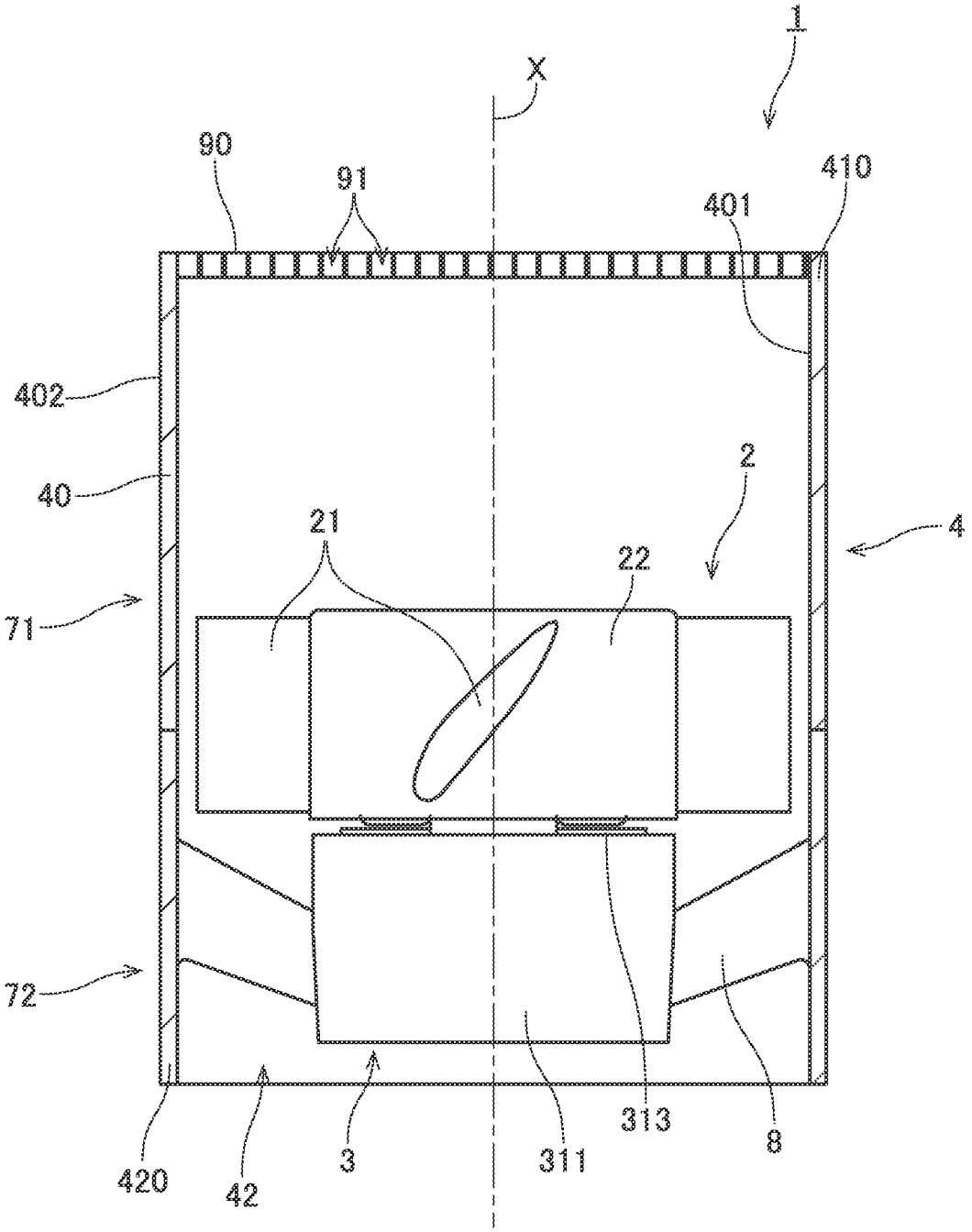
FIG. 1 is a vertical sectional view of a fan according to one preferred embodiment.
Figure 2:
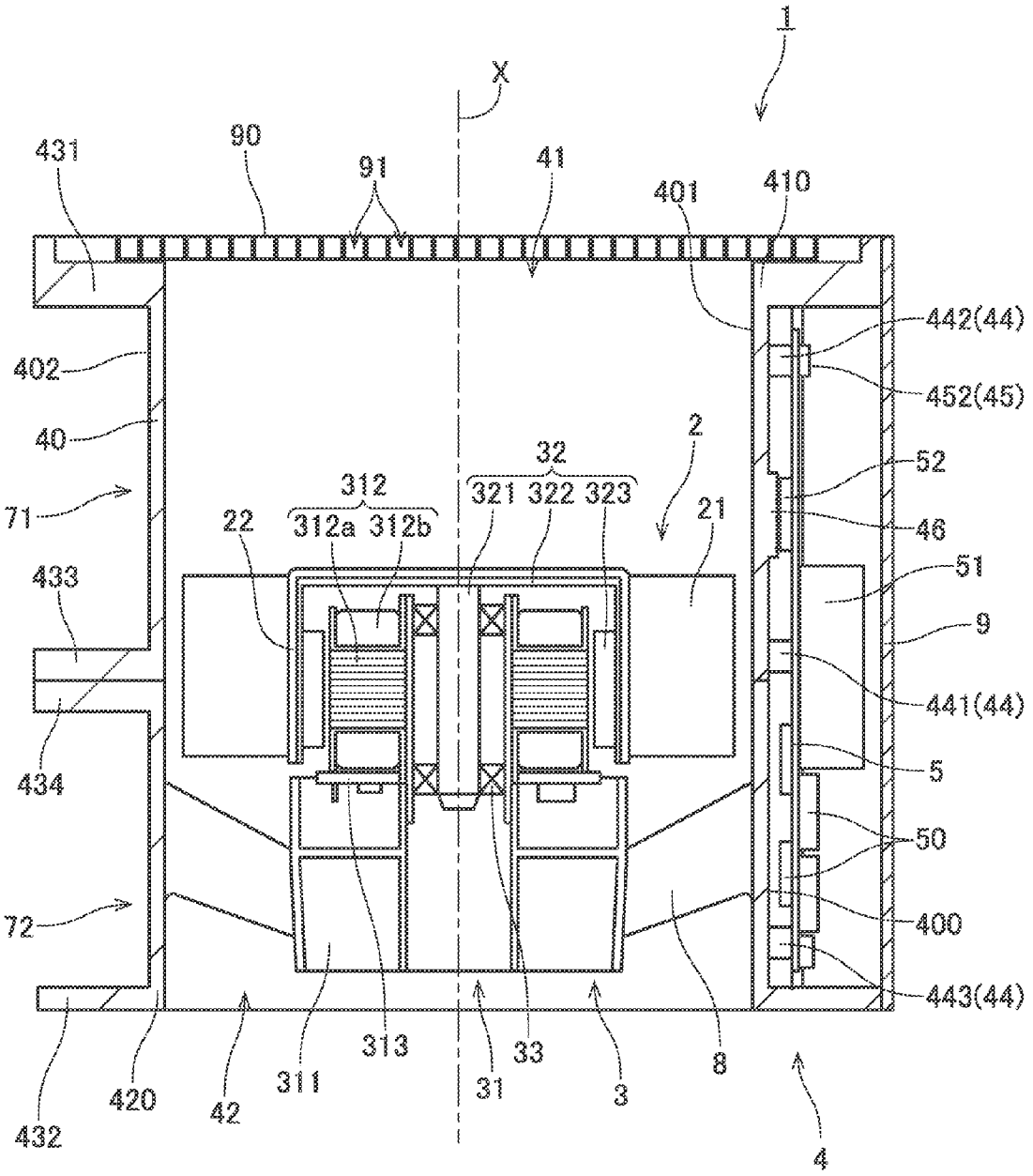
FIG. 2 is a vertical sectional view of the fan according to one preferred embodiment.

FIGS. 1 and 2 are vertical sectional view of a fan 1 according to a first preferred embodiment of the present invention. FIG. 1 illustrates a cross section taken along line A-A in FIG. 3. In FIG. 1, an impeller 2 and a motor part 3 are illustrated without breaking them. FIG. 2 illustrates a cross section taken along line B-B in FIG. 3.

In Fig. fan 1, by virtue of rotation of the impeller 2, an air is drawn from the upper side in FIG. 1 (namely, the upper side of the fan 1) and is discharged toward the lower side (namely, the lower side of the fan 1), whereby a flow of air moving in a center axis X direction is generated. In the following descriptions, in the center axis X direction, the upper side in FIG. 1 at which an air is drawn will be referred to as an "intake side" or simply as an "upper side", and the lower side in FIG. 1 at which an air is discharged will be referred to as an "exhaust side" or simply as a "lower side". The expressions "upper side" and the "lower side" need not necessarily match with the upper side and the lower side in the gravity direction.

As illustrated in FIGS. 1 and 2, the fan 1 includes an impeller 2, a motor part 3, a housing 4, a first circuit board 5 and a plurality of ribs 8.

The impeller 2 is fixed to the motor part 3. The impeller 2 includes a cup portion 22 having a closed-top cylindrical shape and a plurality of blades 21 extending radially outward from an outer circumferential surface of the cup portion 22.

The motor part 3 includes a stationary unit 31 and a rotary unit 32. The stationary unit 31 is kept stationary relative to the housing 4. The rotary unit 32 is rotatably supported with respect to the stationary unit 31. The rotary unit 32 of the motor part 3 rotates the impeller 2 about a center axis X extending in an up-down direction.

The stationary unit 31 includes a cylindrical base portion 311, a stator 312 as an armature fixed to the base portion 311, and a second circuit board 313. The stator 312 includes a stator core 312*a* and a plurality of coils 312*b*. The coils 312*b* are electrically connected to the first circuit board and the second circuit board 313. In the present preferred embodiment, the first circuit board 5 is connected to the coils 312*b* via the second circuit board 313. The second circuit board 313 is disposed under the stator 312 to extend in a direction orthogonal to the center axis X. A plurality of electronic components is mounted on the second circuit board 313.

The rotary unit 32 includes a shaft 321, a rotor hub 322 and a magnet 323. The shaft 321 is a columnar member disposed along the center axis X. The shaft 321 is supported on the stationary unit 31 through bearings 33 so as to rotate about the center axis X. The rotor hub 322 is a closed-top cylindrical member which rotates together with the shaft 321. The rotor hub 322 is disposed above the base portion 311. An inner circumferential surface of the cup portion 22 of the impeller 2 is fixed to an outer circumferential surface of the rotor hub 322. An annular magnet 323 is fixed to an inner circumferential surface of the rotor hub 322. The magnet 323 is radially opposed to an outer circumferential surface of the stator core 312*a*.

In the motor part 3 described above, if a drive current is supplied from an external power source to the coils 312*b* via the first circuit board 5 and the second circuit board 313, magnetic fluxes are generated in the stator core 312*a*. Then, a circumferential torque is generated by the action of magnetic fluxes between the stator core 312*a* and the magnet 323. As a result, the rotary unit 32 and the impeller 2 are rotated about the center axis X with respect to the stationary unit 31. Thus, an air flow moving from the upper side toward the lower side is generated within the housing 4.

As illustrated in FIGS. 1 and 2, the housing 4 includes a cylindrical body portion 40 which surrounds the outer peripheries of the impeller 2 and the motor part 3. The body portion 40 includes a cylindrical inner circumferential surface 401 and a cylindrical outer circumferential surface 402. An upper opening of the body portion 40 of the housing 4 is an intake port 41. A lower opening of the body portion 40 of the housing 4 is an exhaust port 42. The body portion 40 includes an annular upper edge portion 410 disposed at the upper end portion thereof and arranged to surround the intake port 41. Furthermore, the body portion 40 includes an annular lower edge portion 420 disposed at the lower end portion thereof and arranged to surround the exhaust port 42.

As illustrated in FIGS. 1 and 2, a flow straightening grid 90 is disposed in the upper edge portion 410. The flow straightening grid 90 has a plurality of axially-extending through-holes 91. By disposing the flow straightening grid 90 in the upper edge portion 410, it is possible to suppress generation of a swirling component of an air flow which moves from the upper side of the fan 1 toward an internal space of the housing 4 via the intake port 41. This makes it possible to reduce noises generated by the fan 1.

Figure 3:
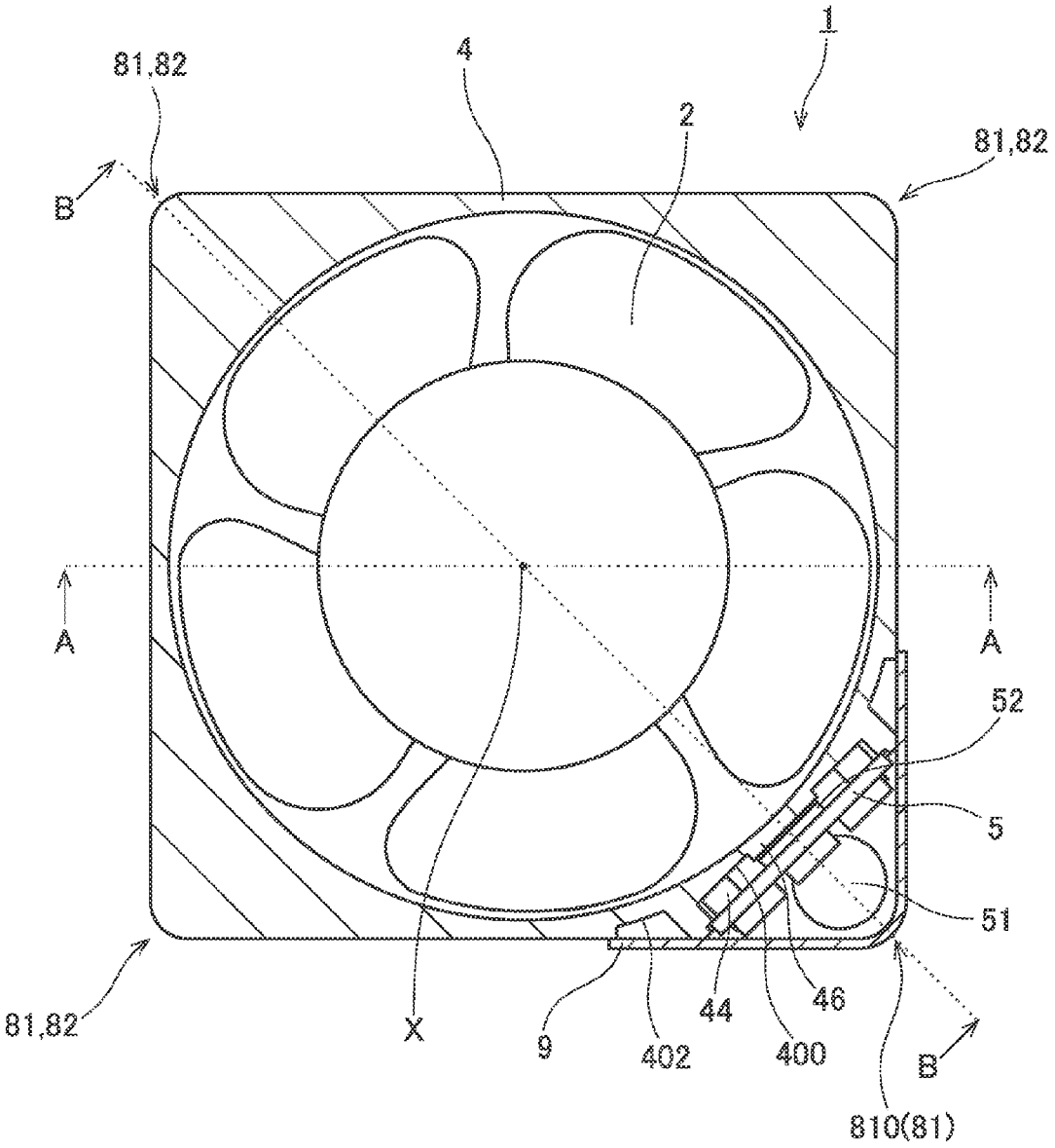
FIG. 3 is a horizontal sectional view of the fan according to one preferred embodiment.

As illustrated in FIGS. 2 and 3, the first circuit board 5 is positioned radially outward of the outer circumferential surface 402 of the housing 4. A plurality of electronic components 50 is mounted on the first circuit board 5. The first circuit board 5 is electrically connected to the coils 312*b* of the motor part 3 and the second circuit board 313.

The ribs 8 interconnect the motor part 3 and the housing 4. More specifically, the ribs 8 extend radially outward from the outer circumferential surface of the base portion 311 of the motor part 3 to the inner circumferential surface 401 of the housing 4. The ribs 8 are disposed below the impeller 2. The ribs 8 may be connected to the outer circumferential surface of the base portion 311 of the motor part 3 and the inner circumferential surface 401 of the housing 4 in an axially-shifted manner. Alternatively, the ribs 8 may be connected to the outer circumferential surface of the base portion 311 of the motor part 3 and the inner circumferential surface 401 of the housing 4 in a circumferentially-shifted manner (see FIG. 2).

Figure 4:
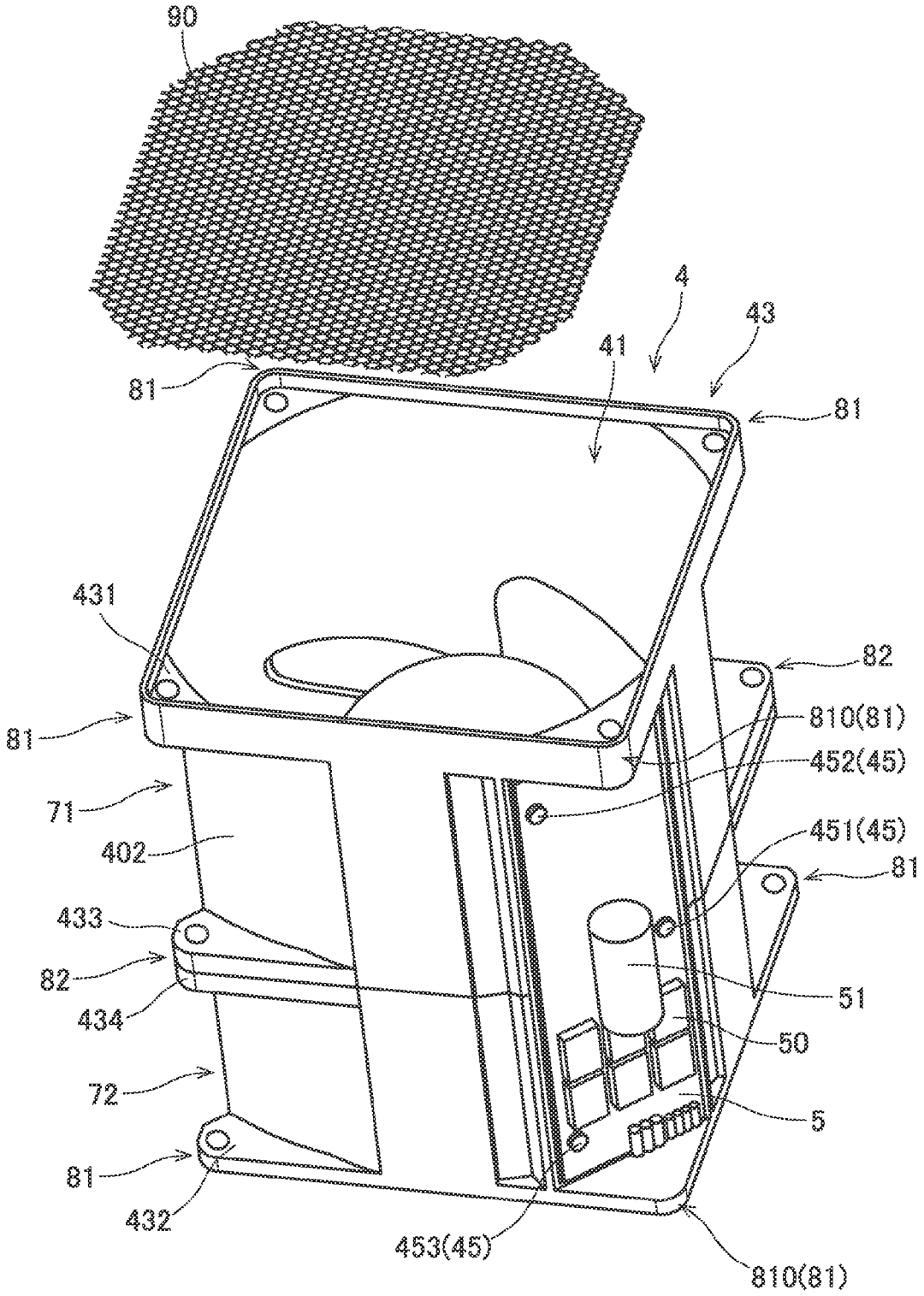
FIG. 4 is a perspective view of the fan according to one preferred embodiment with a cover thereof removed.
Figure 5:
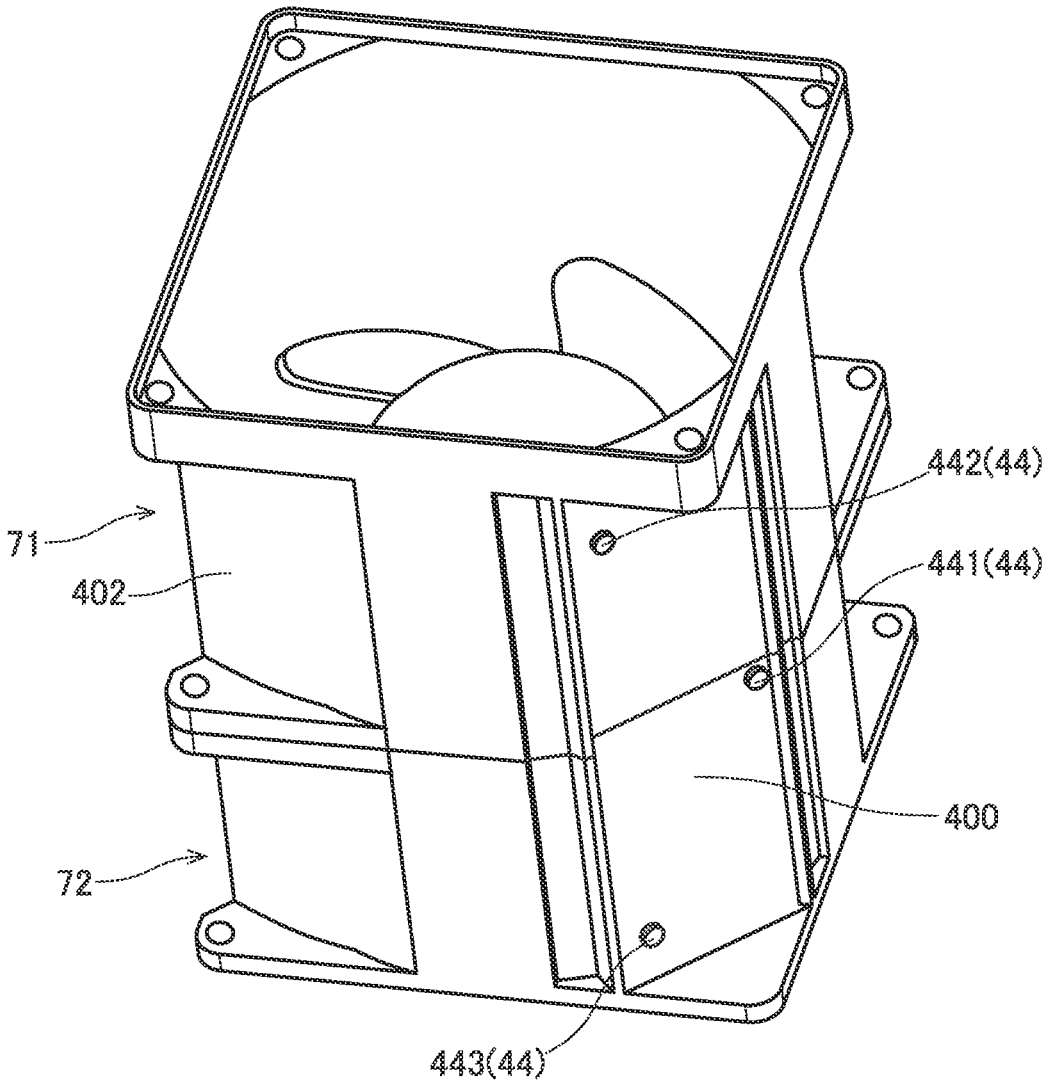
FIG. 5 is a perspective view of the fan according to one preferred embodiment with a first circuit board, a cover and a flow straightening grid thereof removed.
Figure 6:
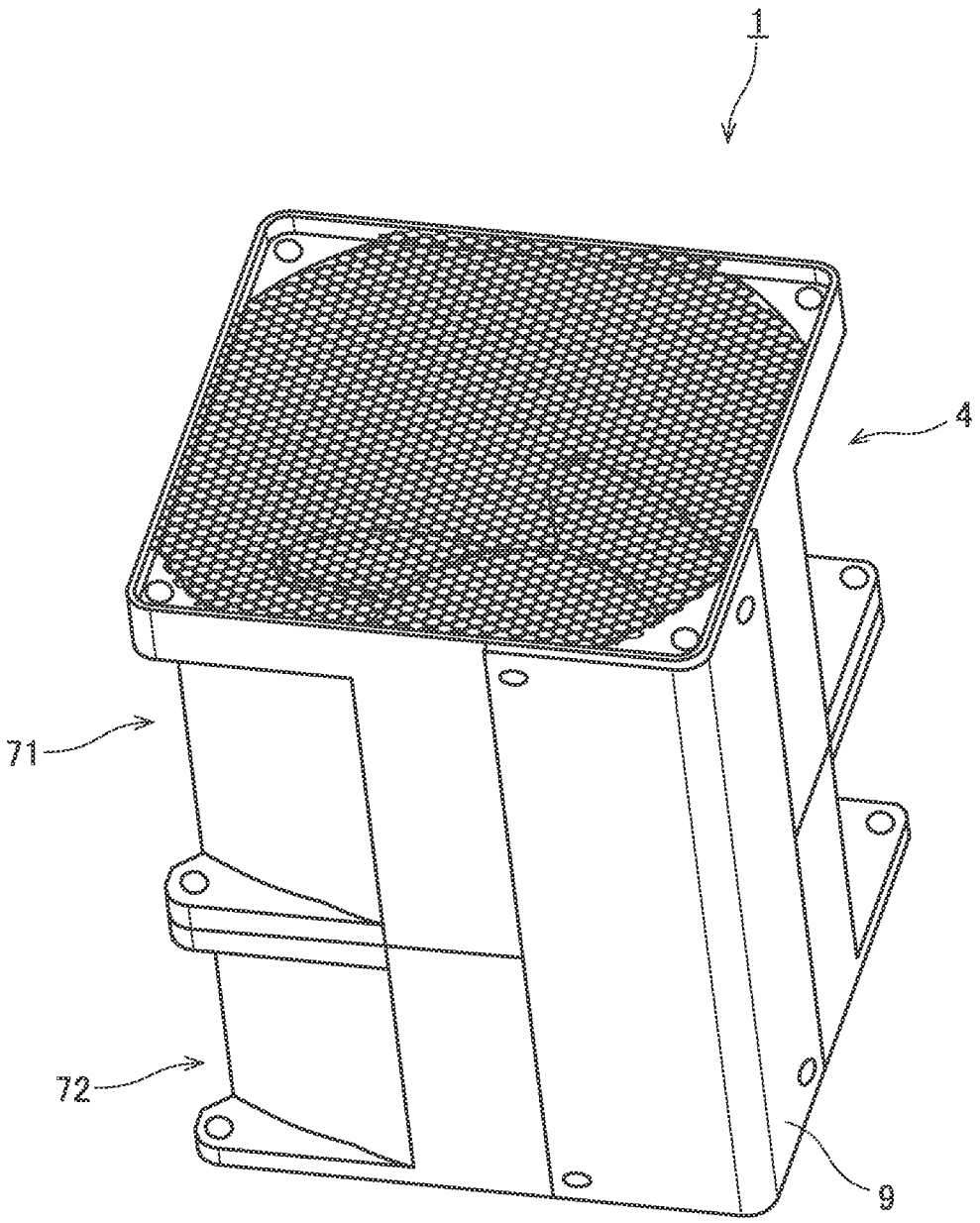
FIG. 6 is a perspective view of the fan according to one preferred embodiment.

Subsequently, the shape of the housing 4 and the arrangement of the first circuit board 5 will be described in detail. FIG. 4 is a perspective view of the fan 1 with a cover 9 thereof removed. FIG. 5 is a perspective view of the fan 1 with the first circuit board 5, the cover 9 and the flow straightening grid 90 thereof removed. FIG. 6 is a perspective view of the fan 1.

As illustrated in FIGS. 1, 2 and 4 to 6, the housing 4 includes a first housing 71 positioned at the axial upper side and a second housing 72 disposed at the axial lower side of the first housing 71. Furthermore, the housing 4 includes a flange portion 43 disposed in at least one of the upper and lower portions thereof and enlarged radially outward from the outer circumferential surface 402.

More specifically, the flange portion 43 includes an upper flange portion 431 and a lower flange portion 432. The upper flange portion 431 is positioned in the upper portion of the housing 4. The lower flange portion 432 is positioned in the lower portion of the housing 4. The shape of radial outer edges of the upper flange portion 431 and the lower flange portion 432 is a substantially square shape having four corner portions 81. The four corner portions 81 are disposed at substantially regular intervals along the circumferential direction. In the present preferred embodiment, the radial outer ends of the corner portions 81 are chamfered in a curved surface shape.

Furthermore, the housing 4 includes a first connection portion 433 positioned in the lower portion of the first housing 71 and a second connection portion 434 positioned in the upper portion of the second housing 72. The first connection portion 433 and the second connection portion 434 are portions enlarged radially outward from the outer circumferential surface 402 of the housing 4. The first connection portion 433 and the second connection portion 434 are fixed to each other. Thus, the first housing 71 and the second housing 72 are fixed to each other. The first connection portion 433 and the second connection portion 434 include three connection corner portions 82.

The three connection corner portions 82 of the first connection portion 433 and the second connection portion 434 are respectively identical in circumferential positions with three of the four corner portions 81 of the upper flange portion 431 and the lower flange portion 432. In this regard, among the four corner portions 81 of the upper flange portion 431 and the lower flange portion 432, the corner portions 81 not axially overlapping with the three connection corner portions 82 of the first connection portion 433 and the second connection portion 434 will be generally referred to as arrangement corner portions 810.

The first circuit board 5 extending in the axial direction is disposed in the circumferential region of the outer circumferential surface 402 of the housing 4 where the arrangement corner portions 810 of the flange portion 43 are positioned. As illustrated in FIG. 3, the first circuit board 5 is disposed along the outer circumferential surface 402 of the housing 4. Furthermore, the first circuit board 5 is disposed in a spaced-apart relationship with the outer circumferential surface 402 of the housing 4. The first circuit board 5 has a flat plate shape extending in the axial direction. In the meantime, as illustrated in FIGS. 3 and 5, the outer circumferential surface 402 includes a planar arrangement surface 400 which radially faces the first circuit board 5. That is to say, the first circuit board 5 and the arrangement surface 400 are disposed substantially parallel to each other.

In this way, the region of the outer circumferential surface 402 of the housing 4 which faces the first circuit board 5 may be a planar surface. In the present preferred embodiment, electronic components 50 are mounted on both the radial outer surface and the radial inner surface of the first circuit board 5. That is to say, the electronic components 50 mounted on the first circuit board 5 are disposed between the arrangement surface 400 and the first circuit board 5. For that reason, if the arrangement surface 400 facing the first circuit board 5 is made planar, it is possible to eliminate regions where the electronic components 50 and the arrangement surface 400 locally come close to each other. Thus, the degree of freedom of disposing the electronic components is improved on the surface of the first circuit board 5 existing at the side of the housing 4.

Furthermore, the housing 4 includes circuit board fixing portions 44 which protrude radially outward and which have seat surfaces facing radially outward and making contact with the first circuit board 5. Specifically, the circuit board fixing portions 44 protrude from the arrangement surface 400 and make contact with the first circuit board 5. That is to say, the circuit board fixing portions 44 are disposed along the arrangement surface 400. As illustrated in FIG. 4, the first circuit board 5 is fixed to the circuit board fixing portions 44 by screws 45. That is to say, in FIG. 4, the screws 45 are disposed in the positions corresponding to the circuit board fixing portions 44. Alternatively, the first circuit board 5 and the circuit board fixing portions 44 may be fixed by other methods such as bonding and the like.

In the fan 1 according to one preferred embodiment of the present invention, a gap may be formed between the first circuit board 5 and the outer circumferential surface of the housing 4 by providing the circuit board fixing portions 44. In the fan 1 according to one preferred embodiment of the present invention, the provision of the circuit board fixing portions 44 makes it possible to fix the first circuit board 5 having the electronic components 50 mounted on the opposite surfaces thereof.

As illustrated in FIG. 5, the housing 4 includes a plurality of circuit board fixing portions 44 disposed in one or both of the circumferential direction and the axial direction. That is to say, the circuit board fixing portions 44 are provided at plural points in the circumferential direction and the axial direction. Specifically, as illustrated in FIGS. 2 and 5, the housing 4 includes an intermediate circuit board fixing portion 441, an upper circuit board fixing portion 442 and a lower circuit board fixing portion 443. The intermediate circuit board fixing portion 441 is disposed on the arrangement surface 400 at one side in the circumferential direction and at a central point in the axial direction. The upper circuit board fixing portion 442 is disposed on the arrangement surface 400 at the other side in the circumferential direction and at the upper side in the axial direction. The lower circuit board fixing portion 443 is disposed on the arrangement surface 400 at the other side in the circumferential direction and at the lower side in the axial direction. The circuit board fixing portions may overlap at least partially in the circumferential direction and/or the axial direction. It is not necessary that the circuit board fixing portions 44 are identical in shape or in width.

FIG. 4 illustrates an intermediate screw 451, an upper screw 452 and a lower screw 453. The intermediate screw 451 fixes the first circuit board 5 to the intermediate circuit board fixing portion 441. The upper screw 452 fixes the first circuit board 5 to the upper circuit board fixing portion 442. The lower screw 453 fixes the first circuit board 5 to the lower circuit board fixing portion 443. As illustrated in FIG. 4, at least one of the electronic components 50 may be disposed at the other side of the intermediate screw 451 in the circumferential direction and at one side of the upper screw 452 and the lower screw 453 in the circumferential direction. In addition, at least one of the electronic components 50 may be disposed at the lower side of the upper screw 452 or at the upper side of the lower screw 453.

That is to say, at least one of the electronic components of the first circuit board 5 is positioned between the intermediate circuit board fixing portion 441, which is a first circuit board fixing portion 44, and the upper circuit board fixing portion 442, which is a second circuit board fixing portion 44. Furthermore, at least one of the electronic components of the first circuit board 5 is axially positioned between the upper circuit board fixing portion 442, which is a first circuit board fixing portion 44, and the lower circuit board fixing portion 443, which is a second circuit board fixing portion 44.

In this way, the first circuit board 5 is fixed to the circuit board fixing portions 44 in the vicinity of the circumferential and axial opposite end portions. Since the first circuit board 5 is supported at the outer side of the housing 4, the vibration thereof is suppressed.

As illustrated in FIG. 2, the lower circuit board fixing portion 443 is disposed lower than the ribs 8. The intermediate circuit board fixing portion 441 is disposed higher than the ribs 8. In this way, the circuit board fixing portions 44 are disposed in an axially spaced-apart relationship with the ribs 8 which transfer vibration from the motor part 3 to the housing 4. Thus, the vibration transferred from the motor part 3 to the housing 4 is further restrained from being transferred to the first circuit board 5.

As illustrated in FIG. 3, the first circuit board 5 is disposed radially inward of the flange portion 43 in an axially-seen plan view. Specifically, the first circuit board 5 is disposed radially inward of the radial outer edges of the upper flange portion 431 and the lower flange portion 432. By disposing the first circuit board 5 between the corner portions of the flange portion 43 and the outer circumferential surface of the housing 4, it is possible to dispose the first circuit board 5 so as not to protrude radially outward of the contour of the flange portion 43.

As illustrated in FIGS. 3 and 4, an electrolytic capacitor 51 is mounted on the first circuit board 5. More specifically, the electrolytic capacitor 51 is mounted on the surface of the first circuit board 5 opposite to the surface which faces the housing 4. When viewed at one axial side, the electrolytic capacitor 51 is disposed in a position overlapping with a virtual straight line which interconnects the center axis X and the corner portion 810 of the flange portion 43. Moreover, the electrolytic capacitor 51 is disposed radially inward of the radial outer edge of the flange portion 43.

As illustrated in FIGS. 3 and 4, when viewed from one axial side, the fan 1 includes a region through which a virtual straight line interconnecting the center axis X and the corner portion 81 of the flange portion 43 radially overlapping with the arrangement position of the first circuit board 5 passes. This region is a region which defines a largest radial space between the outer circumferential surface of the housing 4 and the contour of the flange portion 43. Accordingly, it is possible to dispose the electrolytic capacitor 51 in that region. Thus, the electrolytic capacitor 51 is disposed so as not to protrude radially outward from the flange portion 43.

In the present preferred embodiment, as illustrated in FIGS. 2 and 4, the first circuit board 5 is covered by the upper flange portion 431 and the lower flange portion 432 at the axial opposite sides. This makes it possible to take an insulation measure or a dustproof and waterproof measure with respect to the first circuit board 5. The flange portion 43 may include at least one of the upper flange portion 431 and the lower flange portion 432. In the case where there is a need to take an insulation measure or a dustproof and waterproof measure, it is preferable to provide both the upper flange portion 431 and the lower flange portion 432.

As described above, in the present preferred embodiment, the housing 4 includes the first housing 71 positioned at one axial side and the second housing 72 positioned at the other axial side. The first circuit board 5 is disposed over the first housing 71 and the second housing 72.

In this way, even when the housing 4 is configured by a plurality of housings 71 and 72, the first circuit board 5 is disposed over at least two housings. It is therefore possible to increase the area of the first circuit board 5. This makes it possible to dispose a multiple number of electronic components 50.

Moreover, in the present preferred embodiment, the circuit board fixing portions 44 are respectively disposed in the first housing 71 and the second housing 72. In other words, the first circuit board 5 is disposed on two housings 71 and 72. This enables the first circuit board 5 to be supported substantially at the opposite ends thereof in the axial direction which is the longitudinal direction of the first circuit board 5. Thus, the first circuit board 5 is difficult to have a cantilever shape. For that reason, the first circuit board 5 is not vibrated. This enables the entirety of the fan 1 to become quiet.

As illustrated in FIGS. 2 and 3, the housing 4 includes an electronic component contact portion 46 protruding from the arrangement surface 400 toward the first circuit board 5. Among the electronic components 50 mounted on the first circuit board 5, a heat-generating component 52 that generates a large amount of heat is disposed on the radial inner surface of the first circuit board 5. The heat-generating component 52 and the electronic component contact portion 46 make contact with each other through a heat-conducting material such as a heat-conducting sheet having high heat conductivity or an adhesive agent having high heat conductivity. Thus, the heat generated from the heat-generating component 52 is efficiently transferred to the housing 4.

As illustrated in FIGS. 2, 3 and 6, the fan 1 further include a cover 9 axially extending along the contour of the flange portion 43. The cover 9 is a cover member disposed radially outward of the outer circumferential surface 402 of the housing 4. The cover 9 is a member provided independent of the housing 4. That is to say, in the present preferred embodiment, the first housing 71, the second housing 72 and the cover 9 are independent members.

As illustrated in FIGS. 2 and 3, the cover 9 and the inner circumferential surface 402 of the housing 4 surround the first circuit board 5. That is to say, when viewed at one axial side, the first circuit board 5 is surrounded by the outer circumferential surface 402 and the cover 9. More specifically, the first circuit board 5 is surrounded by the outer circumferential surface 402 of the first housing 71 or the outer circumferential surface 402 of the second housing 72 and the cover 9. This makes it possible to cover the first circuit board 5. Thus, dust hardly adheres to the surface of the first circuit board 5. As a result, it is possible to provide a highly reliable fan 1.

As illustrated in FIG. 6, the first housing 71 and the second housing 72 may be connected by the cover 9. This enables a single component to perform both the connection of the housing 4 and the protection of the circuit board. Accordingly, it is possible to provide a fan 1 having various functions through the use of a reduced number of components.

Figure 7:
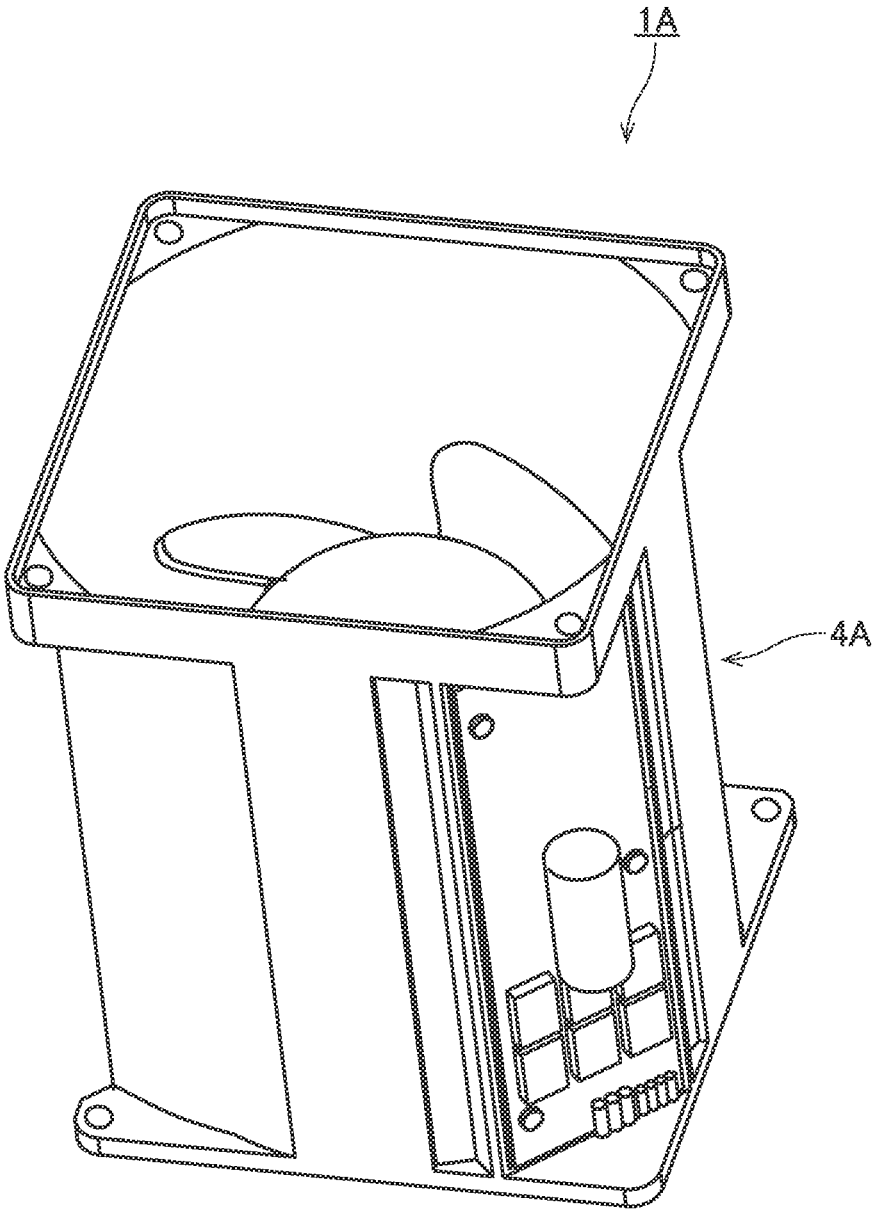
FIG. 7 is a perspective view of a fan according to a modification.

In the fan 1 according to the present preferred embodiment, the housing 4 is formed of two members, namely the first housing 71 and the second housing 72. However, the present invention is not limited thereto. FIG. 7 is a perspective view of a fan 1A according to a modification. As illustrated in FIG. 7, a housing 4A may be formed of a single member.

Figure 8:
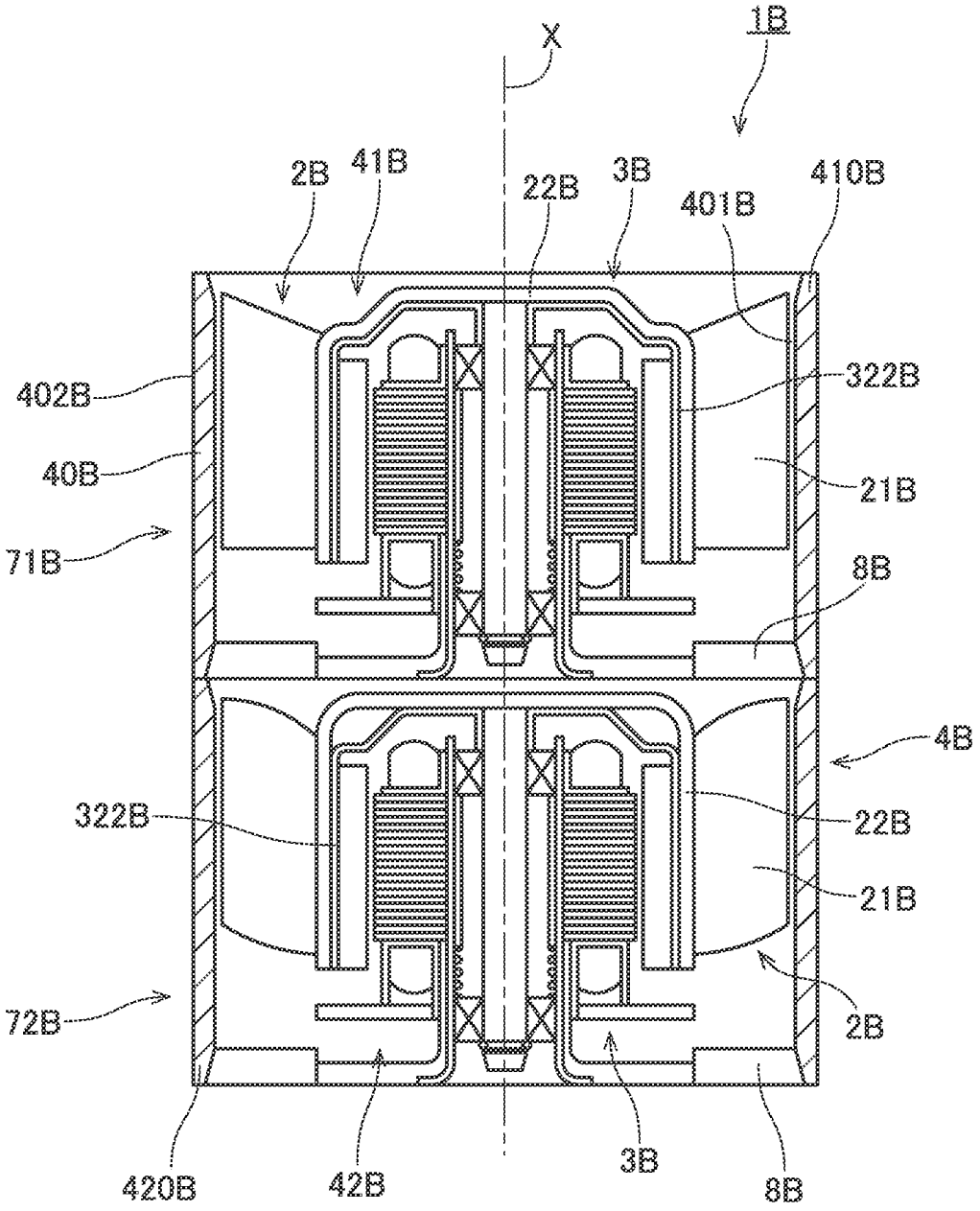
FIG. 8 is a vertical sectional view of a fan according to another preferred embodiment.
Figure 9:
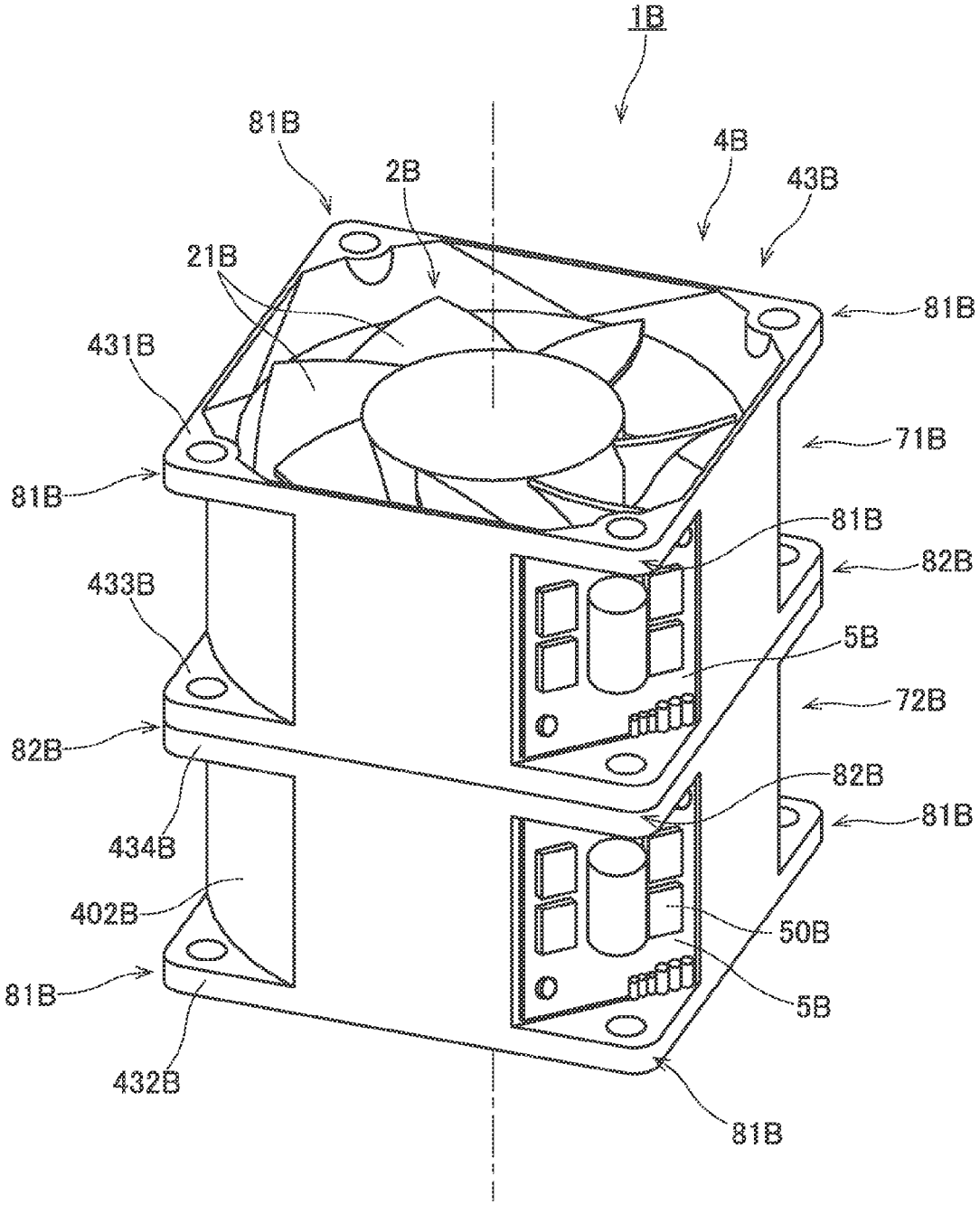
FIG. 9 is a perspective view of the fan according to another preferred embodiment.

FIG. 8 is a vertical sectional view of a fan 1B according to a second preferred embodiment of the present invention. In the fan 1B, similar to the fan 1 according to the first preferred embodiment, the axial upper side in FIGS. 8 and 9 is an intake side, and the axial lower side is an exhaust side.

As illustrated in FIG. 8, the fan 1B includes two impellers 2B, two motor parts 3B, a housing 4B, two first circuit boards 5B and two sets of ribs 8B. The housing 4B includes a first housing 71B positioned at the axial upper side and a second housing 72B disposed at the axial lower side.

One impeller 2B, one motor part 3B and one set of ribs 8B are accommodated at the radial inner side of the first housing 71B. Similarly, one impeller 2B, one motor part 3B and one set of ribs 8B are accommodated at the radial inner side of the second housing 72B.

The impeller 2B is fixed to a rotary unit 32B of the motor part 3B. More specifically, An inner circumferential surface of a cup portion 22B of the impeller 2B is fixed to an outer circumferential surface of a rotor hub 322B of the rotary unit 32B. The impeller 2B includes a plurality of blades 21B which rotates together with the rotary unit 32B of the motor part 3B. The rotary unit 32B of the motor part 3B rotates the impeller 2B about a center axis X extending in the up-down direction. The ribs 8B interconnect the motor part 3B and the housing 4B.

In the fan 1B, the ribs 8B which interconnects the upper motor part 3B and the first housing 71B are disposed below the upper impeller 2B and the upper motor part 3B. Furthermore, the ribs 8B which interconnects the lower motor part 3B and the second housing 72B are disposed below the lower impeller 2B and the lower motor part 3B. Thus, in the fan 1B, the impeller 2B, the ribs 8B, the impeller 2B and the ribs 8B are disposed in the named order from the axial upper side toward the axial lower side.

However, the positions of the ribs 8B are not limited thereto. The ribs 8B may be disposed at the upper side of each of the impellers 2B. The ribs 8B, the impeller 2B, the ribs 8B and the impeller 2B may be disposed in the named order from the axial upper side toward the axial lower side. Alternatively, the positional relationship of the ribs 8B and the impellers 2B may differ at the upper side and the lower side. That is to say, the ribs 8B, the impeller 2B, the impeller 2B and the ribs 8B may be disposed in the named order from the axial upper side toward the axial lower side. The impeller 2B, the ribs 8B, the ribs 8B and the impeller 2B may be disposed in the named order from the axial upper side toward the axial lower side.

In the fan 1B, the upper impeller 2B and the lower impeller 2B differ in rotation direction from each other. That is to say, the fan 1B is a so-called counter-rotating fan. By employing the counter-rotating fan, it is possible to obtain a high wind pressure and a high static pressure without increasing the diameter of the fan. The present invention is not limited to the counter-rotating fan but may be applied to a fan which includes two impellers rotating in the same direction.

As illustrated in FIG. 8, the housing 4B includes a cylindrical body portion 40B that surrounds the impellers 2B and the outer peripheries of the motor parts 3B. The body portion 40B includes a cylindrical inner circumferential surface 401B and a cylindrical outer circumferential surface 402B. An upper opening of the body portion 40B of the housing 4B is an intake port 41B. A lower opening of the body portion 40B of the housing 4B is an exhaust port 42B. The body portion 40B includes an annular upper edge portion 410B disposed at the upper end portion thereof and arranged to surround the intake port 41B. Furthermore, the body portion 40B includes an annular lower edge portion 420B disposed at the lower end portion thereof and arranged to surround the exhaust port 42B.

As illustrated in FIG. 9, the housing 4B includes a flange portion 43B enlarged radially outward from the outer circumferential surface 402B. The flange portion 43B includes an upper flange portion 431B positioned in the upper portion of the housing 4B and a lower flange portion 432B positioned in the lower portion of the housing 4B. The shape of radial outer edges of the upper flange portion 431B and the lower flange portion 432B is a substantially square shape having four corner portions 81B. The four corner portions 81B are disposed at substantially regular intervals along the circumferential direction. The radial outer edges of the corner portions 81B are chamfered in a curved surface shape.

Furthermore, the housing 4B includes a first connection portion 433B positioned in the lower portion of the first housing 71B and a second connection portion 434B positioned in the upper portion of the second housing 72B. The first connection portion 433B and the second connection portion 434B are portions enlarged radially outward from the outer circumferential surface 402B of the housing 4B. Similar to the upper flange portion 431B and the lower flange portion 432B, the shape of radial outer edges of the first connection portion 433B and the second connection portion 434B is a substantially square shape having four connection corner portions 82B. The four connection corner portions 82B are disposed at substantially regular intervals along the circumferential direction. The radial outer edges of the connection corner portions 82B are chamfered in a curved surface shape.

The first connection portion 433B and the second connection portion 434B are fixed to each other. Thus, the first housing 71B and the second housing 72B are fixed to each other.

In the region of the outer circumferential surface 402B of the housing 4B, which overlaps with one of the corner portions 81B in the circumferential direction, two first circuit boards 5B extending in the axial direction are disposed one above another in the axial direction. The upper first circuit board 5B is disposed on the outer circumferential surface 402B of the first housing 71B. That is to say, the upper first circuit board 5B is disposed below the upper flange portion 431B and above the first connection portion 433B. Furthermore, the lower first circuit board 5B is disposed on the outer circumferential surface 402B of the second housing 72B. That is to say, the lower first circuit board 5B is disposed below the second connection portion 434B and above the lower flange portion 432B.

The upper first circuit board 5B is electrically connected to the upper motor part 3B. Furthermore, the lower first circuit board 5B is electrically connected to the lower motor part 3B. As is the case in the fan 1B, the number of the first circuit boards 5B may be two.

While some exemplary preferred embodiments of the present invention have been described above, the present invention is not limited to the aforementioned preferred embodiments.

Figure 10:
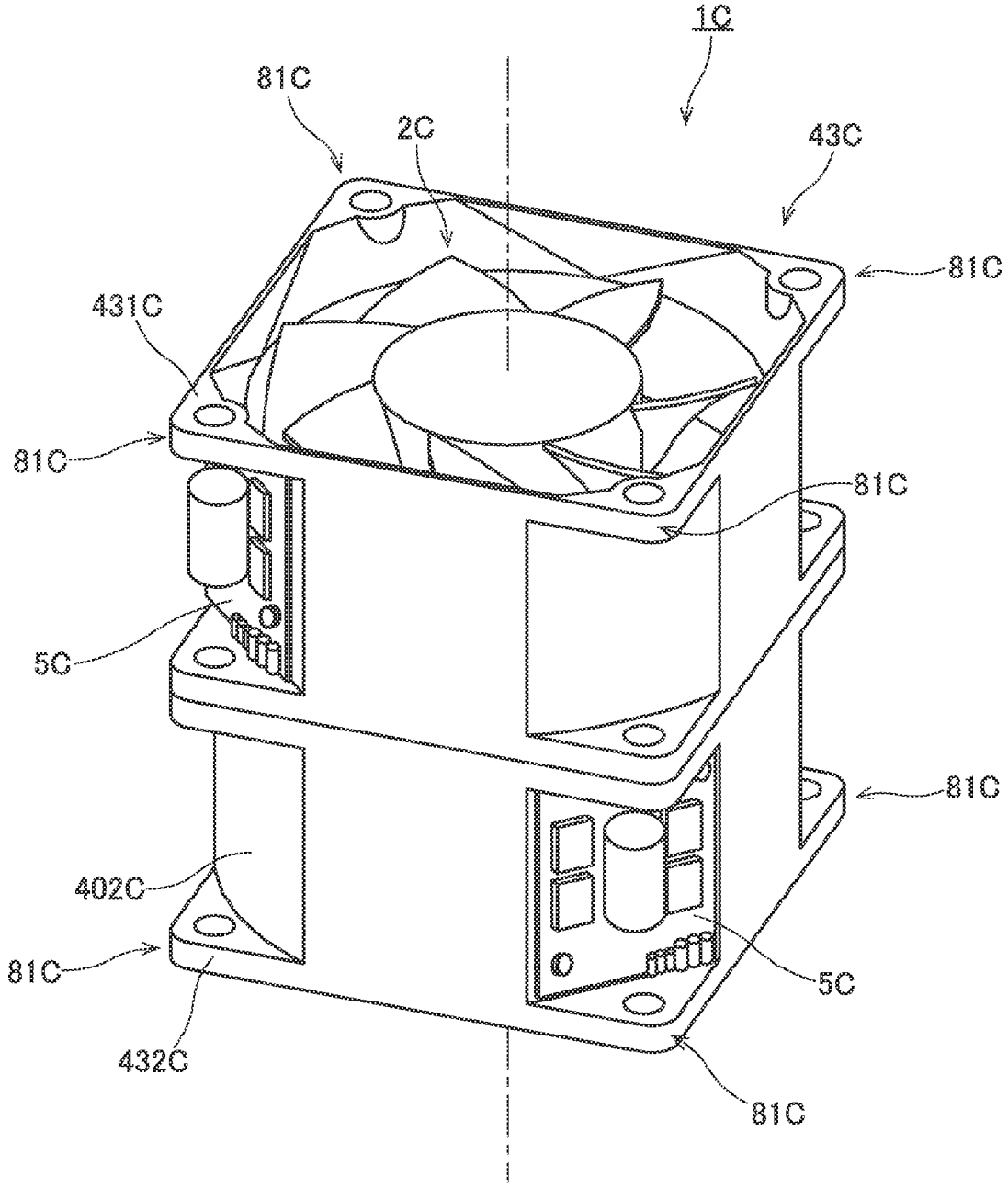
FIG. 10 is a perspective view of a fan according to one modification.

FIG. 10 is a perspective view of a fan 1C according to one modification. Similar to the fan 1B according to the second preferred embodiment, the fan 1C of the modification illustrated in FIG. 10 includes two impellers 2C, two motor parts (not illustrated) and two first circuit boards 5C.

Similar to the fan 1B according to the second preferred embodiment, the housing 4C includes a flange portion 43C enlarged radially outward from the outer circumferential surface 402C. The flange portion 43C includes an upper flange portion 431C positioned in the upper portion of the housing 4C and a lower flange portion 432C positioned in the lower portion of the housing 4C. The shape of radial outer edges of the upper flange portion 431C and the lower flange portion 432C is a substantially square shape having four connection corner portions 81C. The four corner portions 81C are disposed at substantially regular intervals along the circumferential direction. The radial outer edges of the corner portions 81C are chamfered in a curved surface shape.

In the modification illustrated in FIG. 10, the upper first circuit board 5C and the lower first circuit board 5C are disposed in different positions in the circumferential direction. Specifically, the upper first circuit board 5C is disposed in the region of the outer circumferential surface 402C of the housing 4C, which overlaps with one corner portion 81C in the circumferential direction. On the other hand, the lower first circuit board 5C is disposed in the region of the outer circumferential surface 402C of the housing 4C, which overlaps with another corner portion 81C in the circumferential direction. In this way, the two first circuit boards 5C may differ in circumferential position from each other.

Figure 11:
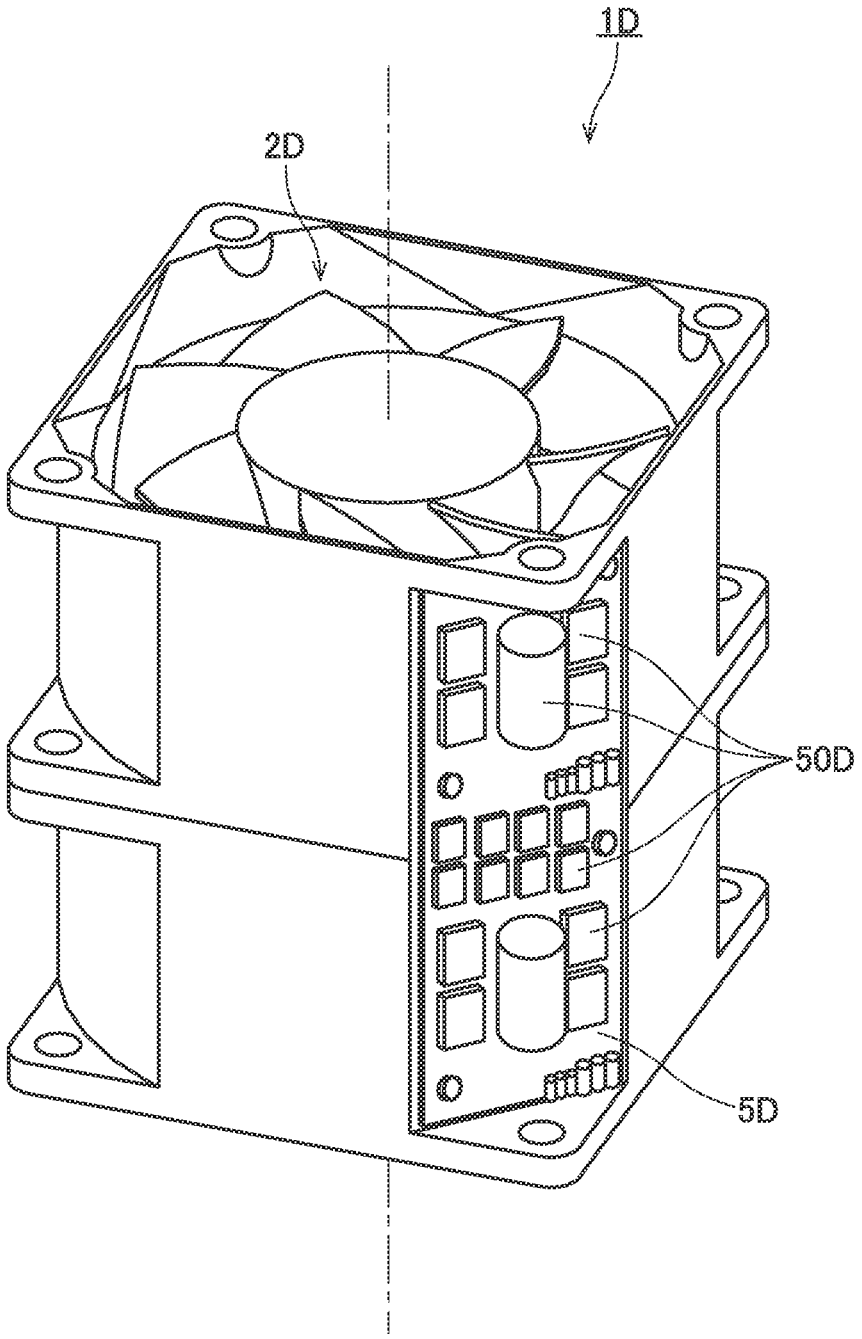
FIG. 11 is a perspective view of a fan according to another modification.

FIG. 11 is a perspective view of a fan 1D according to another modification. Similar to the fan 1B according to another preferred embodiment, the fan 1D of the modification illustrated in FIG. 11 includes two impellers 2D and two motor parts (not illustrated).

The fan 1D includes only one first circuit board 5D. Electronic components 50D electrically connected to the upper motor part and electronic components 50D electrically connected to the lower motor part are mounted on the first circuit board 5D. In this way, the electronic components 50D electrically connected to the two motor parts may be disposed on one and the same first circuit board 5D.

Figure 12:
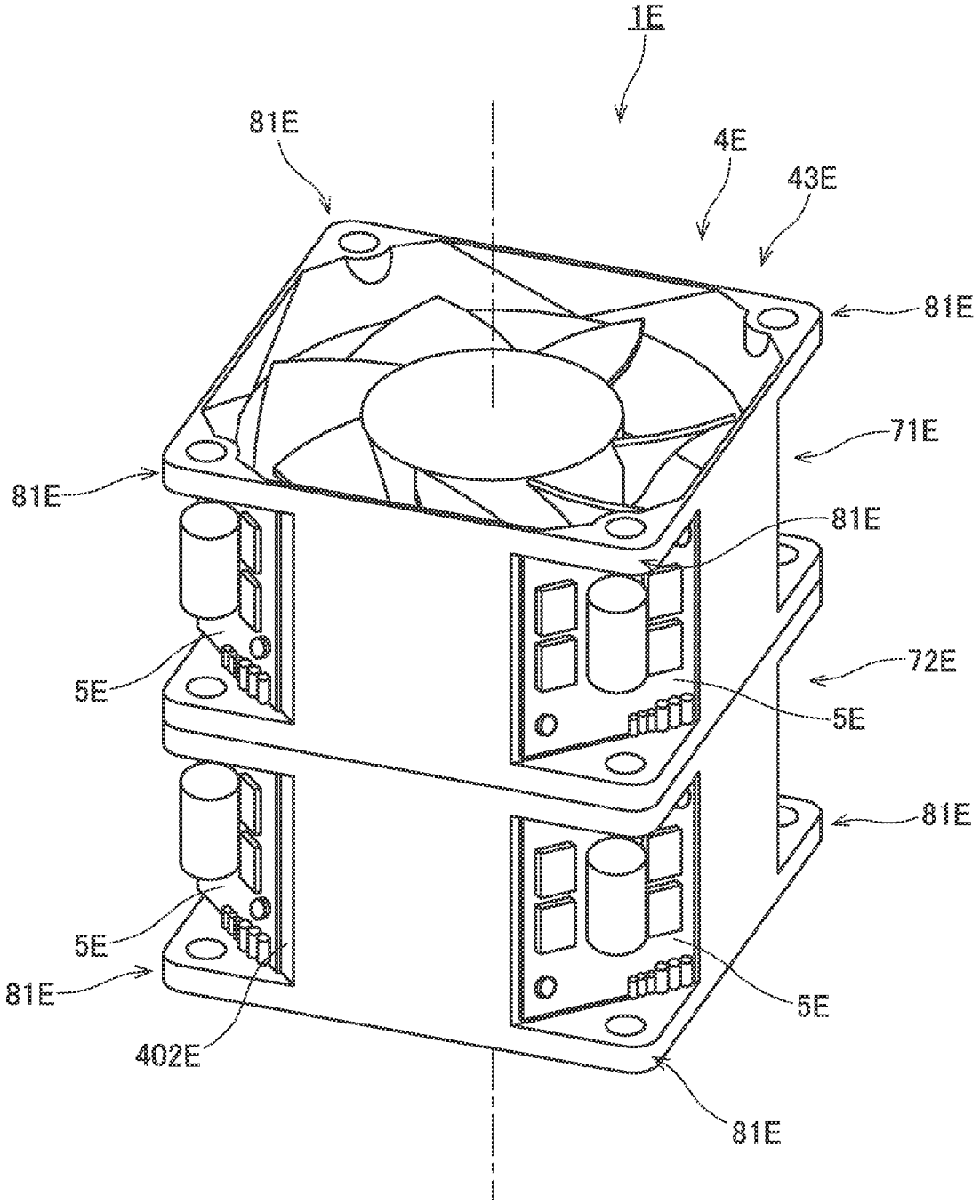
FIG. 12 is a perspective view of a fan according to a further modification.

FIG. 12 is a perspective view of a fan 1E according to a further modification. The fan 1E of the modification illustrated in FIG. 12 includes four first circuit boards 5E. In the preferred embodiments and the modifications described above, a plurality of first circuit boards is not disposed in the same axial position on the outer circumferential surface of the housing. However, the present invention is not limited thereto.

In the modification illustrated in FIG. 12, the housing 4E of the fan 1E includes a first housing 71E positioned at the axial upper side and a second housing 72E positioned at the axial lower side. In the region of the outer circumferential surface 402E of the housing 4E, which overlaps with one corner portion 81E of the flange portion 43E in the circumferential direction, two first circuit boards 5E are disposed one above another in the axial direction. Among the two first circuit boards 5E, the upper first circuit board 5E is disposed on the outer circumferential surface 402E of the first housing 71E, and the lower first circuit board 5E is disposed on the outer circumferential surface 402E of the second housing 72E.

In the region of the outer circumferential surface 402E, which overlaps with another corner portion 81E in the circumferential direction, two first circuit boards 5E are disposed one above another in the axial direction. Among the two first circuit boards 5E, the upper first circuit board 5E is disposed on the outer circumferential surface 402E of the first housing 71E, and the lower first circuit board 5E is disposed on the outer circumferential surface 402E of the second housing 72E. Thus, in the first housing 71E and the second housing 72E, the two first circuit boards 5E are disposed in each of the regions respectively overlapping with two corner portions 81E in the circumferential direction. That is to say, the two first circuit boards 5E are disposed in the same axial position. In this way, a plurality of first circuit boards 5E may be disposed in the same axial position.

Figure 13:
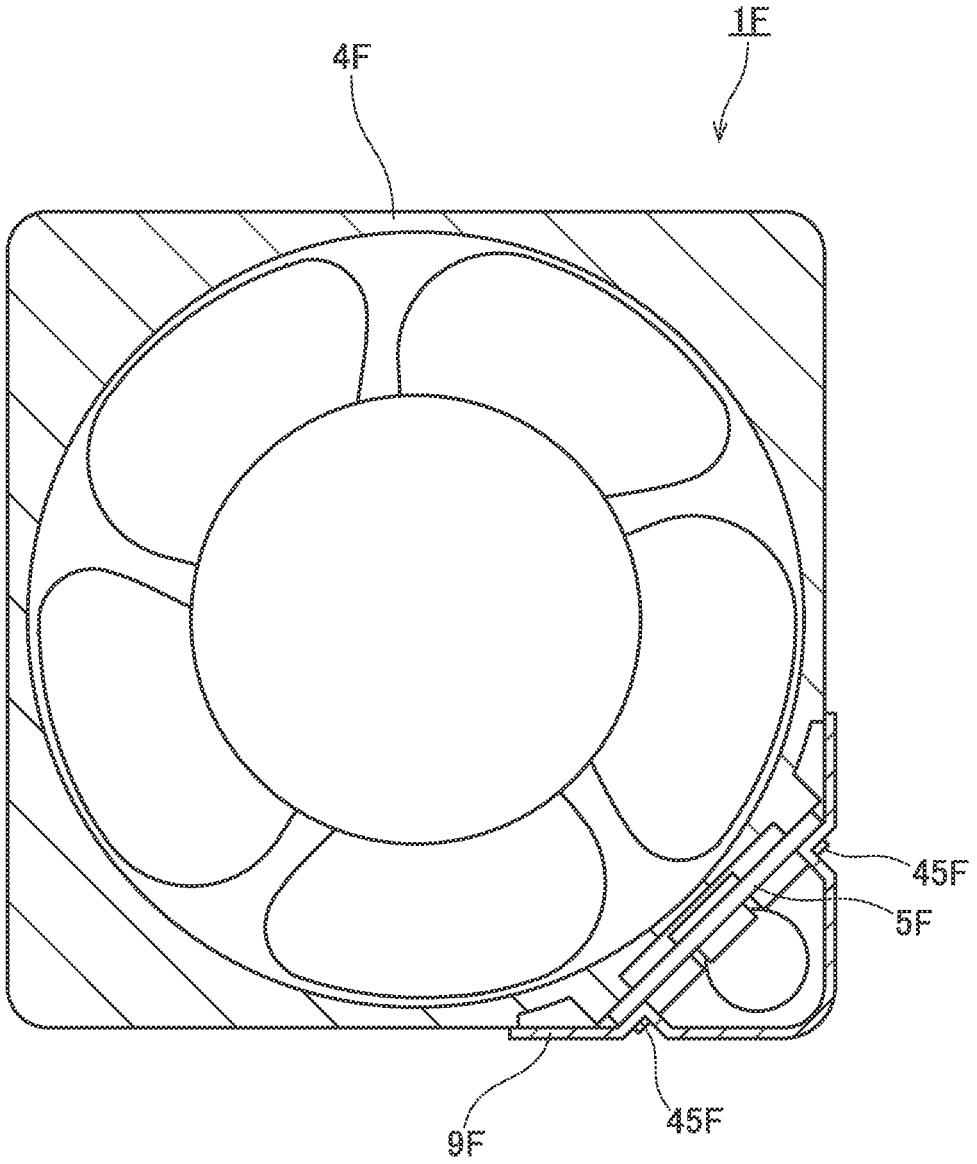
FIG. 13 is a horizontal sectional view of a fan according to a still further modification.

FIG. 13 is a horizontal sectional view of a fan 1F according to a still further modification. The fan 1F of the modification illustrated in FIG. 13 includes a housing 4F and a cover 9F. As illustrated in FIG. 13, by virtue of screws 45F which fix the cover 9F to the housing 4F, a first circuit board 5F is fixed to the housing 4F together with the cover 9F. That is to say, the first circuit board 5F is fixed to the housing 4F by the cover 9F. This enables a single component to perform both the connection of the housing 4F and the cover 9F, and the fixing of the first circuit board 5F. Accordingly, it is possible to provide a fan 1F having various functions through the use of a reduced number of components.

The respective elements appearing in the preferred embodiments and the modifications described above may be appropriately combined as long as no conflict arises.

Features of the above-described preferred embodiments and the modifications thereof may be combined appropriately as long as no conflict arises.

The present invention may be utilized in, e.g., an axial flow fan.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan comprising:

a motor part arranged to rotate about a center axis extending up and down;

an impeller including a plurality of blades extending radially outward, the impeller fixed to the motor part;

a housing arranged to surround outer peripheries of the motor part and the impeller, the housing including a cylindrical inner circumferential surface and a cylindrical outer circumferential surface;

a first circuit board positioned radially outward of the outer circumferential surface of the housing and electrically connected to the motor part; and a plurality of ribs arranged to interconnect the motor part and the housing, wherein the motor part includes an armature having coils, and a second circuit board electrically connected to the coils and the first circuit board, the housing includes an intake port which is an upper opening of the housing, an upper edge which surrounds the intake port, an exhaust port which is a lower opening of the housing, a lower edge which surrounds the exhaust port, a flange portion enlarged radially outward from the outer circumferential surface of the housing, and a circuit board fixing portion protruding from the outer circumferential surface of the housing and making contact with the first circuit board, and the first circuit board is mounted with a plurality of electronic components and is disposed in a spaced apart relationship with the outer circumferential surface of the housing, the first circuit board being positioned radially inward of a radial outer edge of the flange portion and arranged to extend in an axial direction.

2. The fan of claim 1, wherein the shape of a radial outer edge of the flange portion is a substantially square shape having four corner portions, at least an electrolytic capacitor is mounted on the first circuit board, and when viewed in the axial direction, the electrolytic capacitor is disposed in a position overlapping with a virtual straight line which interconnects the center axis and one of the corner portions.

3. The fan of claim 1, wherein the flange portion includes an upper flange portion positioned in an upper portion of the housing and a lower flange portion positioned in a lower portion of the housing.

4. The fan of claim 1, wherein the first circuit board has a shape of a flat plate extending in the axial direction, a region of the outer circumferential surface of the housing, which radially faces the first circuit board, is a planar surface, and the circuit board fixing portion is disposed on the planar surface.

5. The fan of claim 1, wherein the circuit board fixing portion includes a first circuit board fixing portion and a second circuit board fixing portion disposed along a circumferential direction, and at least one of the electronic components of the first circuit board is circumferentially positioned between the first circuit board fixing portion and the second circuit board fixing portion.

6. The fan of claim 1, wherein the circuit board fixing portion includes a first circuit board fixing portion and a second circuit board fixing portion disposed along the axial direction, and at least one of the electronic components of the first circuit board is axially positioned between the first circuit board fixing portion and the second circuit board fixing portion.

7. The fan of claim 1, wherein the circuit board fixing portion includes a plurality of circuit board fixing portions, and at least one of the plurality of circuit board fixing portions is disposed at a lower side of the ribs.

8. The fan of claim 1, wherein the housing includes at least a first housing positioned at an axial upper side and a second housing positioned at an axial lower side, and the first circuit board is disposed over the first housing and the second housing.

9. The fan of claim 8, further comprising:

a cover member provided independent of the first housing and the second housing, and disposed radially outward of the outer circumferential surface of the housing, wherein when viewed in the axial direction, the first circuit board is surrounded by the outer circumferential surface of the first housing or the outer circumferential surface of the second housing and the cover member, and the cover member is arranged to interconnect the first housing and the second housing.

10. The fan of claim 1, wherein the housing includes at least a first housing positioned at an axial upper side and a second housing positioned at an axial lower side, the first circuit board is disposed over the first housing and the second housing, and each of the first housing and the second housing includes the circuit board fixing portion.

11. The fan of claim 1, further comprising:

a cover member provided independent of the housing and disposed radially outward of the outer circumferential surface of the housing, wherein when viewed in the axial direction, the first circuit board is surrounded by the outer circumferential surface of the housing and the cover member.

12. The fan of claim 1, further comprising:

a cover member provided independent of the housing and disposed radially outward of the outer circumferential surface of the housing, wherein the cover member is configured to fix the first circuit board to the housing.

* * * * *